US008431807B1

(12) United States Patent
Beauregard, IV

(10) Patent No.: US 8,431,807 B1
(45) Date of Patent: Apr. 30, 2013

(54) MAGIC KEY OF LEARNING

(76) Inventor: Pierre G. T. Beauregard, IV, North Truro, MA (US)

( * ) Notice: Subject to any disclaimer, the term of this patent is extended or adjusted under 35 U.S.C. 154(b) by 97 days.

(21) Appl. No.: 12/899,000

(22) Filed: Oct. 6, 2010

Related U.S. Application Data

(60) Provisional application No. 61/253,240, filed on Oct. 20, 2009.

(51) Int. Cl.
*G10D 7/12* (2006.01)

(52) U.S. Cl.
USPC ..... 84/377

(58) Field of Classification Search ..... 84/377–379, 84/470 R, 483, 483.2, 484, 471 R1
See application file for complete search history.

(56) References Cited

U.S. PATENT DOCUMENTS 2,263,052 A 11/1941 Ross
2,925,273 A 2/1958 Pratt
3,110,494 A 11/1963 Morgan
4,286,783 A 9/1981 Newcomb et al.
4,846,471 A 7/1989 Haysom
5,309,812 A * 5/1994 Shelton ..... 84/471 R
5,407,193 A 4/1995 McGinley

* cited by examiner

*Primary Examiner* — Kimberly Lockett
(74) *Attorney, Agent, or Firm* — Burns & Levinson LLP; Jerry Cohen

(57) ABSTRACT

This invention is a self-contained, Blow and Draw harmonica-playing, music education device that displays for the student-user—immediately upon viewing the device's coverplates—the location and music symbols for 1./ all of the predetermined fixed music pitches which can be produced on the device (its primary scale—presenting the 1st level of instruction), 2./ one or more of the primary scale's related modal scales (its positions—the 2nd level of instruction) and, 3./ all of the additional non-fixed notes produced by the student-user through the playing techniques of bending & overblowing/overdrawing (the 3rd level of instruction)—with all three levels displayed by three separate sets of numeric music and air direction indicia located on the harmonica device's coverplates directly underneath or overtop their corresponding harmonica reed cavities. The totality of this invention is a harmonica device that is a self-contained, self-teaching educational tool—teaching musical structures & theory, the instrument's particular inner harmony structure, its modal relationships, and, displaying all of the notes playable on the instrument with their exact locations for the very first time.

6 Claims, 7 Drawing Sheets

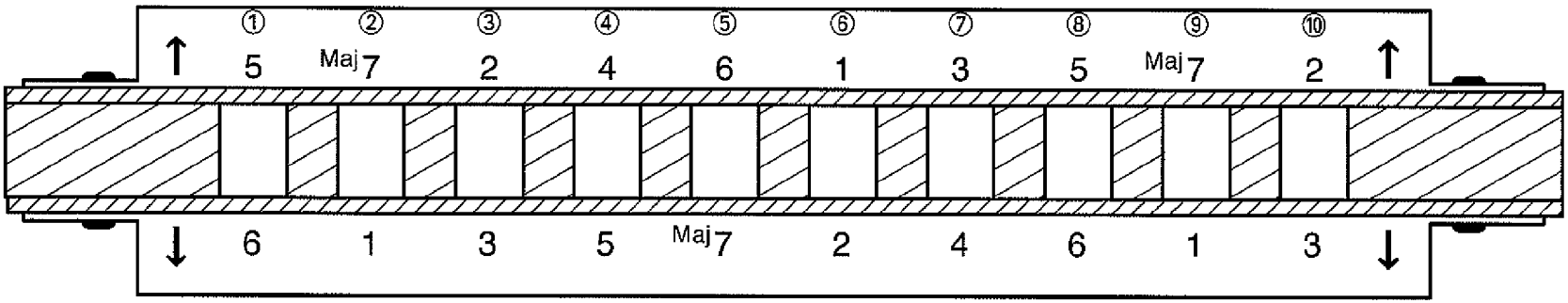
5 Maj 7 1 2 3 4 5 6 1 2 3 4 5 6 7 1 2 3 4 5 6 7 1 2 3 4 5 6 7

MAGIC KEY OF LEARNING

RELATION TO PRIOR APPLICATIONS

This application claims priority from U.S. Provisional Application 61/253,240 filed Oct. 20, 2009.

FIELD OF INVENTION

The present invention relates to harmonica musical instruments and the transformation of such instruments from performance tools into music educational apparatuses.

BACKGROUND OF THE INVENTION

There are many types of harmonicas with the three principal types being the simple "diatonic" harmonica with its single row of typically ten numbered cavities/"holes" (FIGS. 1 and 2), the more complex slide chromatic with its characteristic button & slide mechanism (really two simple harmonicas built into one, activated by the slide) and the well known tremolo body with its double row of cavities (holes). Each cavity (hole) typically houses two differently pitched reeds (shown in FIGS. 1B and 1C with the designation rd)—one that reacts to the blow wind direction (↑) and the other that reacts to the draw wind direction (↓) which usually provide two separate notes of a harmonica's parent (primary) scale in the key of music the harmonica is said to be "tuned in". Typically, the blow-oriented reeds are mounted (e.g. —with rivets, screws, spot welds or other means) to the upper (top) reed plate (FIG. 1B) and the draw-oriented reeds are similarly mounted on the bottom (lower) reed plate (FIG. 1C) and are represented in FIGS. 1B and 1C by black dots though in the case of FIG. 3, all the reeds typically are mounted to only one reed plate. These reed plates in all of the FIGURE drawings are represented by the designation RP in FIGS. 1 and 1A and the narrower-lined hatching and are covered by the integral top and bottom coverplates (represented by the designations CP in FIGS. 1 and 1A). These upper (top) and lower (bottom) coverplates project the sound of the instrument but most importantly are there to protect the reeds from being muted out by fingers or the hands of the player. All harmonicas must have these integral coverplates to function properly. Though they appear flat in most of the FIGURE drawings, the coverplates are actually curved in shape so as not to allow the motion of the reeds underneath to touch the coverplates and ruin the sound (see FIG. 1A). For all of the "front view" FIGURE drawings (1, 3-6 and 8) the designation bd (in FIGS. 1 and 1A) and the wider-lined hatching shows the body of a harmonica, typically made of wood or plastic, which forms the aforementioned cavities (holes) that inside house the reeds mounted on their respective reed boards. The cavities (holes) are represented in these same "front view" drawings by the designation ca (in FIG. 1) and the smaller "inside" blank white boxes in the body (not shown in FIGS. 2, 7, 9, 10 and 11 because of their "top or bottom view" perspectives). To complete its sandwich-like construction and by the way of example, the double black dots found on the far end "wings" of the coverplate in FIG. 2 and other "top or bottom views" of the FIGURE drawings represent the nails, screws or other fastening means that hold the whole assembly of the harmonica together. In FIG. 1 and other "front view" FIGURE drawings they are shown in low profile on the far end "wings" of both the upper (top) and lower (bottom) coverplates. In the case of the tremolo body with its doubled rows of cavities (holes) housing four different reeds, each reed is doubled in pitch in its partner cavity/hole (the stacking of cavities/holes) and set slightly out of tune with its same wind direction partner achieving the tremolo harmonica's characteristic oscillating tone and tremolo sound, the "French café accordion sound" (the accordion is tuned similarly). Some types even have these doubled notes tuned an octave apart which produces a wider, fuller sound. Though not shown in the FIGURE drawings, the present invention's system of note identification and location perfectly mates with these models as it does with other BLOW and DRAW models. The simple diatonic harmonica is the representative BLOW and DRAW model chosen to exemplify the present invention's concept.

Typically, each cavity (hole) of these types of harmonicas is identified on the upper (top) coverplate of the harmonica by a numeric label. This sequential system of numbers, typically in Arabic numerals (1, 2, 3 etc.), goes from left to right as shown in FIGS. 1 & 2 and corresponds to pitches from low to high. In this way, numbers are being used strictly to identify the location of a particular cavity (hole). While these numeric labels are critical for helping a performer locate a particular cavity (hole) and assist in the hand-eye coordination necessary to successfully position the embouchure on said cavity, they are not intrinsically useful in educating the music student in musical principles and their application to the learning of music in general and harmonica playing in particular. They don't tell the player what's actually found there in relation to music and the harmonica's musical structure & its tuning layout. However, there is a way to use numbers in a manner that is more musical and logical, and for the first time on a harmonica educational—for defining in relative terms the musical notes of any key; and to use those same numbers to indicate the cavity (hole) location of the notes on the harmonica. In doing so, it transforms the instrument from a performance tool into a self-teaching apparatus that simultaneously teaches the player the structure of music and where each note is found on the harmonica. That is the utility of the present invention.

These types of BLOW and DRAW-oriented harmonicas are available in the twelve different keys of music (i.e.—The Keys of A, $A^{\#}/B^{b}$, B, C, $C^{\#}/D^{b}$, D, $D^{\#}/E^{b}$ E, F, $F^{\#}/G^{b}$, G and $G^{\#}/A^{b}$), but for each key the internal progression of notes is generally the same. Each note and key of music is represented by a letter of the alphabet (i.e.—The Key of A is represented by its most important prime note, its tonic—the note of A. It's the same condition in principle for all of the twelve keys of music). The key of each harmonica is typically located on extreme far right hand side of the harmonica's upper (top) coverplate, as shown in FIG. 2 with the letter "C" representing the particular key the harmonica is said to be "tuned in", though some manufacturers put it on the ends. These types of harmonicas are also manufactured in a number of different tuning layouts (schemes), each with a different kind of primary scale be it of minor or major tonality or a standard primary scale with one or two altered notes. They are also typically available in the twelve keys of music.

Other all-blow harmonica embodiments (not currently popular) typically have used these letters of the alphabet & letters of the chromatic scale as labeling in place of cavity (hole) numbers (FIG. 3). The standard bass harmonica, the polyphonia, the "chromatica" and other harmonica-like tuning pitch pipes (FIG. 3) are examples of this absolute, alpha (i.e.—in alphabetical order) type of system. The alpha labeling on these harmonicas serves a similar purpose as the cavity number labeling on the BLOW and DRAW embodiments, and that is to help the performer identify a particular cavity (hole) and assist in the hand-eye coordination necessary to successfully position the embouchure on the desired cavity.

This labeling does not exploit the full potential of the diatonic harmonica and other BLOW and DRAW models to be used as musical education tools that can simplify the process of learning and studying music for the student. Letters don't show clearly the mathematical relationships of musical notes and intervals, the main ingredients of chords and songs. Numbers can and do this very well when used to describe degrees of the scale instead of just cavity (hole) location. With letters used to represent the scale, twelve different key/letter combinations have to be learned and memorized for the comprehension of "lettered" music. While this may be practical on a transpositional instrument such as the piano or saxophone for which a distinct playing pattern must be employed for each musical key, it is not ideal for the non-transpositional instrument such as the diatonic harmonica on which the same playing patterns will produce an identical musical performance but in a different key simply by playing on a harmonica pitched in that key. The number of musical relationships presented by the alpha system is twelve times greater than the number of relationships presented using the number system to represent the same musical patterns. The letter system of representing music is "key-dependent" (changes for each musical key) and does not lend itself well to the diatonic harmonica and other "keyed" BLOW and DRAW models, which are played using the same patterns for every key. The numeric system, on the other hand, is "key-independent" (remains exactly the same for each musical key) and applies ideally to the diatonic harmonica and the other "keyed" BLOW and DRAW models. One simply plays the same numeric patterns on harmonicas pitched in different keys to perform the same patterns in different keys. For this reason, these harmonicas have the potential to reduce the knowledge of relationships between pitches required to perform music by a factor of twelve. The present invention is designed to exploit this potential of the diatonic harmonica and other BLOW and DRAW models to be used as music educational tools.

THE MUSICAL NUMBER SYSTEM

There is a universal system commonly in use to describe music, its different scale degrees, chords and structure in terms of numbers instead of letters of the alphabet. It most likely came from the numbering of Pythagoras' original mapping of the major scale and its related modal scales (modes). It is by nature a much clearer and easier way to conceive of music. Instead of learning twelve combinations and differentiations of letters for each of the twelve keys in music, one relative system using numbers works conceptually in the same way for all of the twelve keys. Letters are still used but now conceptually more as a starting point for any song or identifying a particular key. This is what is meant by "playing a song in a particular key", the Key of C for instance. They are also still the accepted medium for standard written music on the Western five-lined musical staff. Yet numbers show music's structure, notes' relationships and interactions with one another (harmony or disharmony) much better. This is because of basic mathematics being the underlining structure of music and how its intervals are not only constructed but also heard. There is a mathematical logic in hearing harmony and how & what it emotionally relates to us as humans. Herman Helmholtz proved this in the late 1800s when he charted the inner ear, how we hear, and developed the whole modern basis for analyzing the nature and the structure of sound. He discovered the true understanding of the overtone series and its natural harmonic structure with math (and also interestingly, by measuring sound on single harmonica reeds in vacuums).

The system is simply based on the conventional major scale of any key and follows as such: 1 (do), 2 (re), 3 (mi), 4 (fa), 5 (so), 6 (la), $^{Maj}7/^{M}7$ (ti) and then to complete the cycle . . . up to "do" again (the 1 or the 8/AKA—"the octave"). The system does go past there to describe chord and scale extensions beyond the octave (the 8) with a $9^{th}$ scale degree being the same as the 2 (re) an octave higher in pitch, a $10^{th}$ for 3, 11/4, 12/5, 13/6 etc. The number system, similar to the letter system, uses flat (b) and sharp (#) symbols to represent the "half-step" scale notes (the accidentals) but places the flat or sharp signs before the number ($^{b}7$) whereas letters have it after ($B^{b}$). Thus the complete twelve note chromatic scale of any key in numbers is as follows: 1, $^{b}2$, 2, $^{b}3$, 3, 4, $^{b}5$, 5, $^{b}6$, 6, $^{b}7$, and $^{Maj}7/^{M}7$ completed with 8, the octave of the 1. Beyond the octave it continues on up with: $^{b}9/^{b}2$, 9/2, $^{\#}9/^{b}3$, 10/3, 11/4, $^{\#}11/^{b}5$, 12/5, $^{b}13/^{b}6$ and 13/6 (it usually ends here) on thru to 16, the next octave. It is a relative system of ordinal music numbers and not "key dependent", as opposed to the conventional "key dependent" absolute system, which uses letters to represent musical notes.

Music teachers now commonly use this number system to teach piano and the concepts of music. Most modem musicians also informally converse with the use of this same musical number system. The present invention uses this well accepted number system to now identify and locate the said notes of a harmonica. The harmonica's key would continue to be labeled by the letter system as has been done since the first harmonicas were made. Individual music keys need the absolute system of letters to be identified. That, and labeling chromatic all-blow harmonicas such as FIG. 3, is where letters function well.

The universal ordinal music number system typically represented in Arabic numerals is used throughout this invention's written descriptions and FIGURE drawings (FIGS. 4 thru 11) yet it will be obvious to any others skilled in the arts there are other similar relative systems that can symbolize the same concept of musical note identification and note location such as Roman numerals or solfeggio word equivalents, or combinations of the various systems and can substitute for the Arabic numbers and create other embodiments of this invention not shown here but intended to be covered by the present invention's claims.

U.S. Pat. No. 4,402,249 to Zankman discloses a harmonica education system that is somewhat different in scope and intention than the present invention. His invention is a system for reading sheet music (in harmonica tablature) that is held by a stand that attaches to the back of the harmonica. His system is an attachment for playing songs from sheet music and is song-centric. It is a system for assisting the performer in navigating, in series, the notes required to play a song. It does not teach the math-based structure of music itself as would be applied to give the player an understanding of (a) the location of all of the notes on the harmonica and (b) the musical relationships of said notes. Zankman's invention only shows the notes needed to play particular songs—and his system continues to locate these notes by the standard method of identifying the cavity (hole) numbers that they are located in. His stand system is also not an integral part of the instrument that is necessary for the harmonica to function properly. In contrast, the present invention does indicate where all of a harmonica's notes are located, what relative scale degree they are in ordinal musical numbers—and does both with the same symbols, thus simplifying the process of learning the comprehensive structure of all music. As a result, the present invention is a fully functional, stand alone educational system, unlike Zankman's invention which is a guide for playing individual songs. It is also displayed (stamped or otherwise)

on a permanent integral part of the instrument (its coverplates) and in that way, it is always there to assist the player without having an unwieldy stand that must be purchased separately and then attached to the instrument to hold harmonica tablature song sheets or music educational literature.

SUMMARY OF THE INVENTION

This present invention (as shown in FIGS. 4-11) provides for all BLOW and DRAW harmonicas, represented here by the simple diatonic harmonica, a new and superior yet very simple education system displayed directly within its integral coverplates with the purpose of assisting the student in the immediate identification, in key-independent music scale degree numbers, of its primary scale's notes, some of its other related modal scales, the additional notes of the chromatic scale that are playable on it (referred to as "additional associated notes"), and, at the same time with the same symbols, where they are located—all done for the first time on the harmonica and all seen for the first time in a quick glance. It is augmented by related wind direction arrows and the said cavity (hole) numbers (which are now circled for better identification). While teaching an understanding of music through the use of scale degree numbers (its true math-based structure), the present invention also teaches the student exactly where every playable note is located and does so simultaneously with the same symbols for both.

It is done with the aforementioned universal ordinal musical number system represented typically by Arabian numerals being stamped, etched, painted, lasered or put on by any other graphical means of representation within the harmonicas' integral said coverplates instead of cavity (hole) labels as has been done in the past. By placing the harmonica's numbered scale degrees within the structure of its coverplates above and below their associated cavities (holes), the student can immediately see where to start to play the primary scale of the harmonica (typically at the "1"—the key's tonic root note), where the notes of its primary scale are located and where they are repeated higher up (or lower) in pitch. Through the use of superscripting and subscripting, a simple harmonica's additional associated "overblow", "overdraw" and "bend" notes (facilitated thru the use of advanced harmonica playing techniques) are now also identified and located with their associated cavities/holes for the first time. It is also a first for the slide chromatic harmonica with its primary scale and additional associated notes (achieved by activating its slide/button mechanism) being identified & located on the coverplates with the purpose of assisting the student. Having other secondary related scales displayed in any model's coverplates is another first along with using the coverplates themselves as primary scale wind direction indicators.

For the beginning harmonica student, FIGS. 4, 6, 7, 10 and 11 reduce this concept to its simplest forms displaying only the primary scale degrees, related wind direction arrows and circled cavity (hole) numbers on the coverplate(s) or the primary scale with its other related modal scales. This makes it even easier for the beginning student to take in the understanding of basic music principles. FIGS. 10 and 11 reduce it to being contained within only one of the coverplates. FIGS. 5, 8 and 9 on the other hand present the primary scale plus their additional associated chromatic notes produced by the more advanced harmonica techniques of overblowing (or overdrawing) and bending. FIG. 9 shows these additional chromatic notes of the other related modal scales also.

The primary scale's blow (↑) notes, their additional superscripted overblows ($\uparrow^5$—as shown in FIGS. 5 and 8), blow-oriented (subscripted) bends ($\uparrow_5$—in the case of FIG. 5—blow cavities/holes 7 thru 10), and circled cavity/hole numbers (①) above the scale degrees, are placed on the front of the harmonica's upper (top) coverplate, overtop the cavities (holes) they are located in. By being located on the upper (top) coverplate this indicates that these notes are acquired by blowing. To reinforce the wind direction needed for each note, blow wind direction arrows are also located on the sides of the upper (top) coverplate in line with these blow-oriented scale indications. The primary scale's draw (↓) notes with their additional subscripted bend notes ($\downarrow_5$—as shown in FIGS. 5 and 8), additional superscripted overdraw notes ($\downarrow^5$—in the case of FIG. 5—draw cavities/holes (⑦) thru ⑩) are placed on the front of the harmonica's lower (bottom) coverplate underneath the cavities (holes) they are located in. By being located on the lower (bottom) coverplate this indicates that these notes are acquired by drawing. To reinforce this, draw wind direction arrows are also located on the sides of the lower (bottom) coverplate in line with these draw-oriented scale indications. Additionally (as shown in FIGS. 7, 9 and 11), a harmonica's other important related scales/modes (known in harmonica vernacular as "playing in other positions") are located on the bottom (lower) coverplate from left to right underneath their associated cavities (holes) in vertical (or possible horizontal) fraction form, showing the location of their blow notes in the numerator's place and their draw notes in the denominator's place of the fraction. In the case of FIG. 9, the additional associated overblow (superscripted) and bend (subscripted) notes (from the perspective of the secondary related scales) are also displayed with their associated secondary scale degrees. In the beginner embodiments of FIGS. 10 and 11, all of the harmonica's primary scale numbers and their locations are contained within only one of the said coverplates, typically the upper (top) coverplate as in FIG. 10. However, as in FIG. 11, they can also be contained within the lower (bottom) coverplate along with their other related scales, which leaves the upper (top) coverplate open for the conventional cavity (hole) numbers as shown in FIG. 2 of Prior Art or other information, artwork, etc.

The present invention allows the student to see the notes and their locations immediately before and directly associated with playing them, all done in a quick glance. It also constantly reminds the student of the structures of music thus reinforcing the learning of music in manner that is lacking in the conventional harmonica. It essentially turns the harmonica into a music theory teaching apparatus using musical numbers, the true language of music.

There are two specific harmonica tuning schemes used in this document to exemplify the application of the present invention's system within the structure of the integral coverplates of the harmonica, yet it is to be understood that any tuning scheme can be incorporated within the structure of a harmonica's coverplates in such a fashion. The first tuning scheme (used in FIGS. 4 and 5) is the original Richter tuning layout (from 1826) found in conventional diatonic harmonicas and other similar models. The Richter tuning layout is shown from its draw note perspective, AKA "cross-harp", for easier comparison with the second, fuller and more complete, "harmony" tuning scheme used in FIGS. 6 thru 11 (which are also shown from their draw note perspective, the object of their tuning design). "Cross-harp" refers to playing a harmonica based in its "Draw Key", typically the mixolydian mode of the major scale or fifth degree of the scale in which the harmonica is pitched (i.e. —playing a C harmonica in the Key of G), instead of the early 1800s traditional way it was played, oriented towards its "Blow Key" (i.e. —playing a C harmonica in the Key of C). Though not intended to be seen as the primary scale of importance by the original inventor (he looked at it from the blow note perspective)—this draw note oriented, cross-harp perspective has now become the most popular way to play harmonica in today's modern music and is now looked upon as the harmonica's primary scale of importance instead of being viewed as one of the secondary related scales. Its popularity probably has to do with the increased expression that is obtained when played in "Draw" with its inherent bending capabilities on its prime chord tones (Draw cavities/holes ① thru ⑤ of FIG. 5). There are other modem harmonica tuning systems currently made with primary scales that are also based in this draw-oriented cross-harp perspective. This is also why cross-harp's draw perspective was chosen to help illustrate the present invention's education system of harmonica note identification and their location. Yet it should be understood that a Richter tuning layout and others can also be presented with the present invention's system of primary scale degree numbers referring instead to the traditional "blow perspective" of a harmonica (AKA "straight harp"), or referring to the perspectives of any of their related modal scales or unrelated scales built off of the other chromatic notes. The present invention's system of note identification and location works for any BLOW and DRAW model of harmonica, any voicing of any tuning, any scale, from any note's perspective and in any location, thus essentially turning each different one into its own self-teaching musical device with a common language between all of the different models and music—relative musical numbers.

Other objects, features and advantages will be apparent from the following detailed description of preferred embodiments taken in conjunction with the accompanying drawings in which:

BRIEF DESCRIPTION OF THE DRAWINGS

FIG. 6 illustrates the front view of a harmonica's upper and lower (top and bottom) coverplates constructed in accord with another preferred embodiment of the present invention with another more complete scaled "harmony" tuning layout. Meant for the beginner player, it shows only its primary blow and draw-oriented scale notes in scale degree numbers on the upper and lower coverplates respectively. Related wind direction arrows on the far sides of the face of each coverplate and circled cavity (hole) numbers (on the upper/top coverplate) are also shown.

FIG. 7 illustrates a "bottom view" of the embodiment of FIG. 6's lower (bottom) coverplate constructed in accord with the present invention. At the top is displayed the primary scale draw notes in scale degree numbers underneath their associated cavities (holes) with related wind direction arrows on its far sides. Below that are other related modal scales in scale degree numbers and wind direction arrows in vertical fraction form—the numerator represents the blow notes/blowing and the denominator represents the draw notes/drawing.

DETAILED DESCRIPTION OF THE INVENTION

Figure 1:
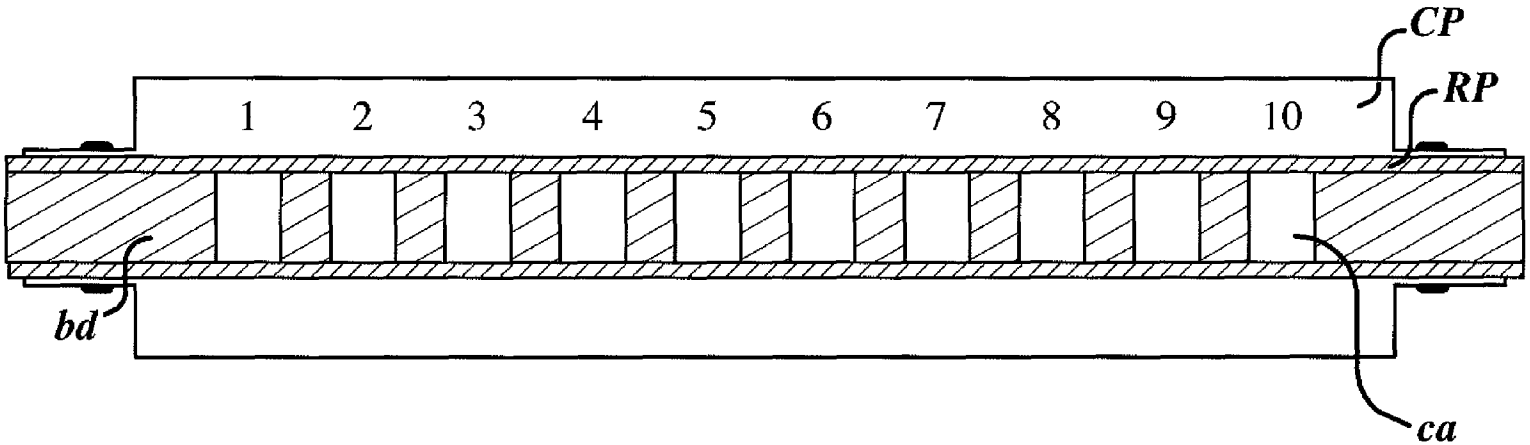
FIG. 1 (PRIOR ART)
FIG. 1 (Prior Art) illustrates a conventional simple diatonic harmonica from the "front view" of its embodiment with its cavity (hole) numbers showing on its upper (top) coverplate.
Figure 1A:
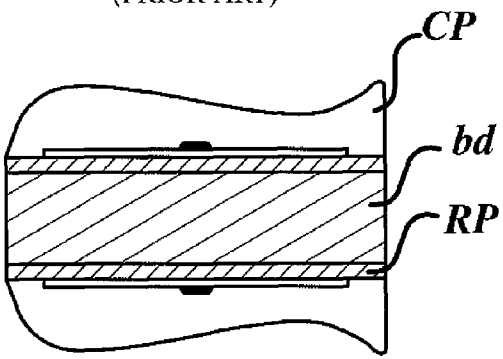
FIG. 1A (PRIOR ART)
FIG. 1A (Prior Art) illustrates the diatonic harmonica of FIG. 1 from its "end view" showing the curved profile of both the upper (top) and lower (bottom) coverplates.
Figure 1B:
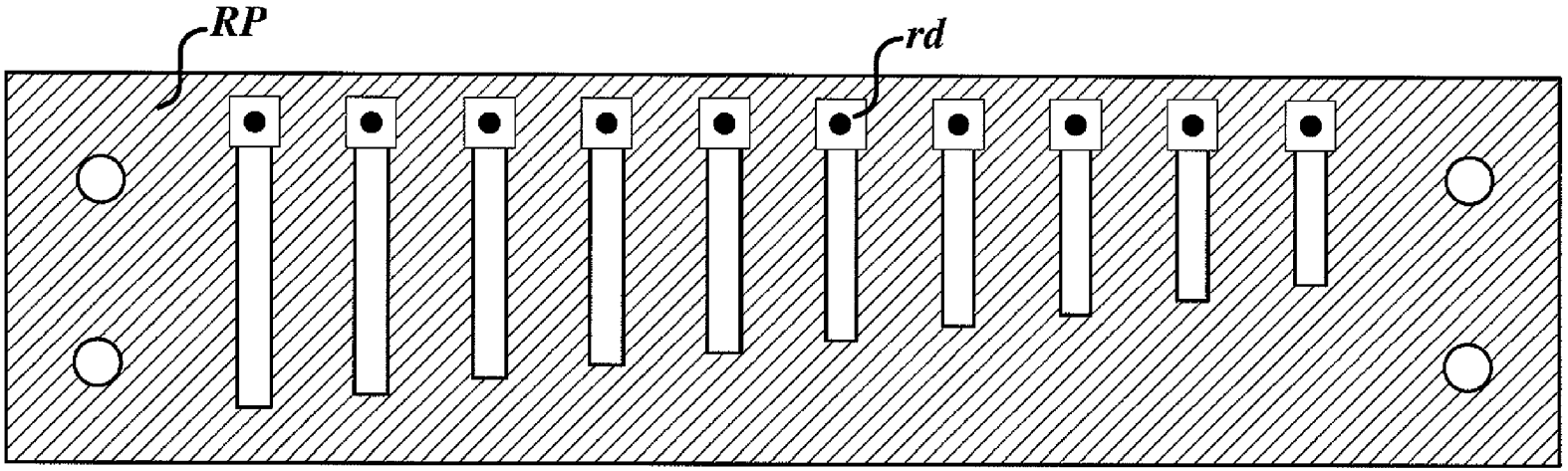
FIG. 1B (PRIOR ART)
FIG. 1B (Prior Art) illustrates a harmonica's top (blow) reed plate with its blow reeds.
Figure 1C:
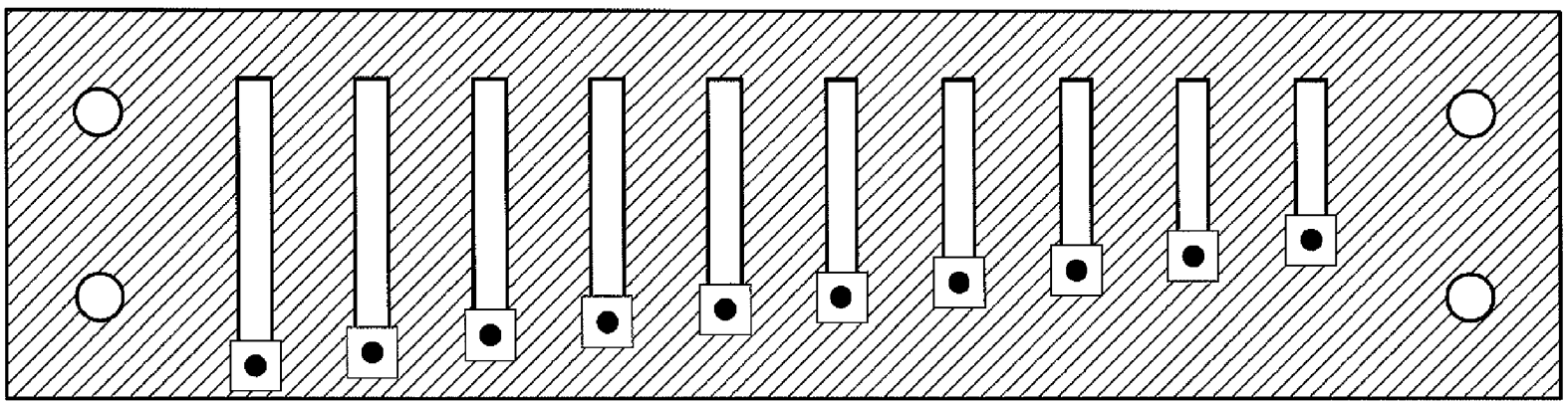
FIG. 1C (PRIOR ART)
FIG. 1C (Prior Art) illustrates a harmonica's lower (draw) reed plate with its draw reeds.
Figure 2:
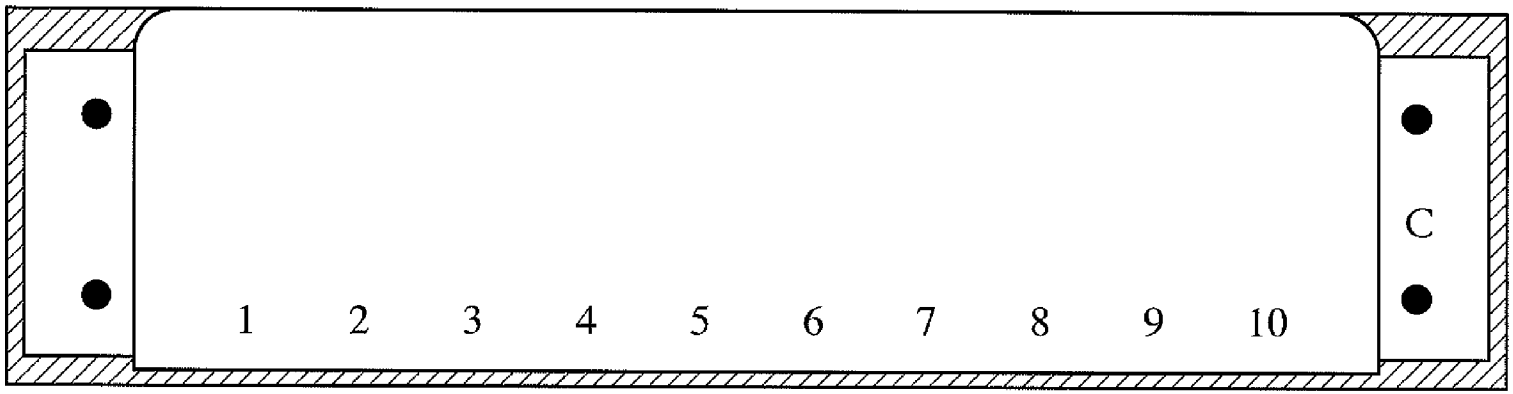
FIG. 2 (PRIOR ART)
FIG. 2 (Prior Art) illustrates the "top view" of the upper (top) coverplate of FIG. 1 showing from that perspective its same said cavity (hole) numbers.

Referring first to FIGS. 1 & 2, there is illustrated a conventional diatonic harmonica, from a front view and top view respectively, that has above each cavity (hole) of the harmonica's upper (top) coverplate, typically in Arabic numerals, a sequential series of numbers (1, 2, 3, etc.) that shows the location of each of the said cavities (holes). This sequential number system representing the location of each cavity (hole) goes from left to right and typically corresponds to the reeds in each cavity (hole) rising in pitch from their lowest pitches upwards thru to their highest pitches. In this way of using reference numbers, each number refers specifically and strictly to just the location of each particular cavity (hole). Typically there are ten cavities (holes) in a conventional diatonic harmonica but there certainly can be more if so desired. The cavities (holes) are represented in the "front view" drawings of FIGS. 1, 3-6 and 8 by the designation ca (in FIG. 1) and the smaller "inside" blank white boxes (not shown in FIG. 2, 7, 9, 10 or 11 because of their "top or bottom view" perspectives). Typically in each cavity (hole) there are two free reeds (as shown by the designation rd in FIGS. 1B and 1C)—one that reacts to the blow wind direction (↑) typically located on the top reed plate (FIG. 1B) and the other reed that reacts to the draw wind direction (↓) typically mounted on the lower reed plate (FIG. 1C). Such mountings can be done with rivets, screws, spot welds or other means and are represented as black dots in FIGS. 1B and 1C. Each reed typically is made to produce a separate note of the harmonica's fixed pitched scale (the primary scale). The reeds are mounted to what's known as the harmonica's reed plates (represented by the designation RP in FIGS. 1 and 1A and the narrow-lined hatching in the drawings). These are attached to the main body of the harmonica (represented by the designation bd in FIGS. 1 and 1A and the wider-lined hatching in the drawings) which is typically made of wood or plastic. There are typically two reed plates per harmonica, one that has the blow reeds attached to it (FIG. 1B) and the other mounting the draw reeds (FIG. 1C). Each reed plate is covered with the integral part of a metal coverplate (represented by the designation CP in FIGS. 1 and 1A)—thus there are typically two coverplates per harmonica. Though they appear flat in most of the FIGURE drawings, the coverplates are actually curved in shape (as shown in FIG. 1A) so as not to allow the motion of the reeds underneath to touch the coverplates and ruin the sound. One of the integral coverplates typically covers the blow oriented reeds and blow reed plate, this usually being the upper (top) coverplate. Typically, as shown in FIG. 2, on its extreme far end is found a letter (in this case, the letter "C") which represents the key that the harmonica is said to be "tuned in". The other integral coverplate, the lower (bottom) coverplate, typically covers the draw oriented reeds and the draw reed plate. These coverplates protect the motion of the reeds so that they can't be muted out by the player's fingers or hands and thus the reeds are freely able to produce the scale's pitches that the reeds are intended to make. The coverplates also allow the harmonica to be held comfortably by the player's hands and fingers. They also help to form the tone and projection of the sound of the instrument. Without the said coverplates, a harmonica's way of producing sound would be impractical and problematic. This is why they are necessary and integral parts of a harmonica's construction. To complete its sandwich-like construction and by the way of example, the double black dots found on the far end "wings" of the coverplate in FIG. 2 and other "top or bottom views" of the FIGURE drawings represent the nails, screws or other fastening means that hold the whole assembly of the harmonica together. In FIG. 1 and other "front view" FIGURE drawings they are shown in low profile on the far end "wings" of both the upper (top) and lower (bottom) coverplates.

Figure 3:
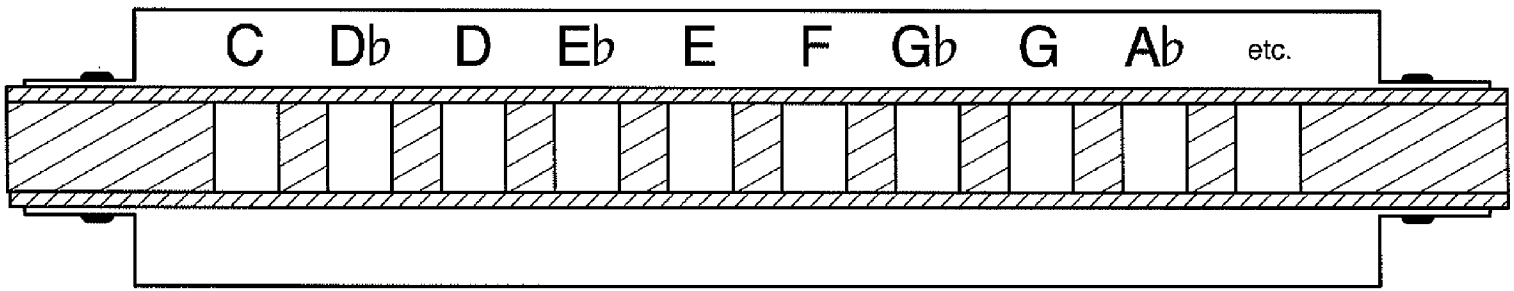
FIG. 3 (PRIOR ART)
FIG. 3 (Prior Art) illustrates the front view of an exclusively all-blow oriented harmonica's upper (top) and bottom (lower) coverplates to show the use of the absolute alpha system (i.e.—in alphabetical order) of the chromatic scale's letters instead of cavity (hole) numbers for said harmonica's note locations.

Referring now to FIG. 3, there is illustrated an exclusively all-blow oriented harmonica. The standard bass harmonica and harmonica-like pitch pipes are typical examples of this all-blow arrangement. They, like all harmonica embodiments, have reeds that are mounted on a reed plate (in FIG. 3's case, on only one reed plate, typically the upper/top one because they are all-blow embodiments) and are covered with the aforementioned integral coverplates which perform the same functions as mentioned above. The one difference is in the labeling scheme used to help the performer identify a particular cavity (hole) and successfully position the embouchure over the particular cavity. All-blow harmonicas typically employ letter labels stamped onto the upper (top) coverplate instead of the numeric labels typically stamped onto the BLOW and DRAW harmonicas. The advantage of doing such on the all-blow harmonica labels is that each individual pitch is displayed as a musical letter name. The limits of this kind of system are defined by the fact that: 1/ letters don't directly teach the true understanding of music because music's structure is based upon mathematics, and numerals are culturally the most easily understood language symbols of mathematics. Letters don't show as clearly as scale degree numbers the constructs and forms of scales, intervals, and, 2/ it is an absolute system and would have to be changed for each different key of a particular harmonica and these all-blow embodiments come in only one key—the "chromatic key" that contains all of the twelve notes of Western & European scales and music. The reason it works is that these particular types of harmonicas have the full chromatic scale in them and play in all keys not just one key that simple "diatonic", slide-chromatic, and tremelo harmonicas are said to be "tuned in". Their absolute note labeling does not exploit the full potential for transforming the harmonica into the great music educational tool it can be. That requires the present invention. The present invention uses the simple diatonic harmonica to illustrate its unique concepts and is representative of what can be done to all of the other similar BLOW and DRAW models.

The present invention goes well beyond both previously used systems in that it uses numbers in a different, more logical and educational way to indicate the harmonica's scale's degrees and their location—instead of just as cavity (hole) labels. As a result, the student is able to see not only the location of all the harmonica's notes, but simultaneously, with the same said numbers, the degree of the actual provided scale with which they are identified as (their scalar identification). All this is done with a quick glance at the present invention's integral coverplates.

The universal ordinal music number system, typically represented in Arabic numerals, is used throughout this invention's written descriptions and FIGURE drawings (FIGS. 4 thru 11) yet it will be obvious to any others skilled in the arts there are other similar relative systems that can symbolize the same concept of musical note identification and note location such as Roman numerals or solfeggio word equivalents, or combinations of the various systems and can substitute for the Arabic numbers and create other embodiments of this invention not shown here but intended to be covered by the present invention's claims.

There are two specific harmonica tuning schemes used in this document to exemplify the application of the present invention's system within the structure of the integral coverplates of the harmonica, yet it is to be understood that any tuning scheme can be incorporated within the structure of a harmonica's coverplates in such a fashion. The first tuning scheme (used in FIGS. 4 and 5) is the original Richter tuning layout (from 1826) found in conventional diatonic harmonicas and other similar models. The Richter tuning layout is shown from its draw note perspective, AKA "cross-harp", for easier comparison with the second, fuller and more complete, "harmony" tuning scheme used in FIGS. 6 thru 11 (which are also shown from their draw note perspective, the object of their tuning design). "Cross-harp" refers to playing a harmonica based in its "Draw Key", typically the mixolydian mode of the major scale or fifth degree of the scale in which the harmonica is pitched (i.e. —playing a C harmonica in the Key of G) instead of the early 1800s traditional way it was played, oriented towards its "Blow Key" (i.e. —playing a C harmonica in the Key of C). Though not intended to be seen as the primary scale of importance by the original inventor (he looked at it from the blow note perspective)—this draw note oriented, cross-harp perspective has now become the most popular way to play harmonica in today's modern music and is now looked upon as the harmonica's primary scale of importance instead of being viewed as one of the secondary related scales. Its popularity probably has to do with the increased expression that is obtained when played in "Draw" with its inherent bending capabilities on its prime chord tones (Draw cavities/holes ① thru ⑤ of FIG. 5). There are other modem harmonica tuning systems currently made with primary scales that are also based in this draw-oriented cross-harp perspective. This is also why cross-harp's draw perspective was chosen to help illustrate the present invention's education system of harmonica note identification and their location. Yet it should be understood that a Richter tuning layout and others can also be presented with the present invention's system of primary scale degree numbers referring instead to the traditional "blow perspective" of a harmonica (AKA "straight harp"), or referring to the perspectives of any of their related modal scales or unrelated scales built off of the other chromatic notes. The present invention's system of note identification and location works for any BLOW and DRAW model of harmonica, any voicing of any tuning, any scale, from any note's perspective and in any location, thus essentially turning each different one into its own self-teaching musical device with a common language between all of the different models and music—relative musical numbers.

Reference is now made to the FIGS. 4-6 and 8, "front view" perspectives of the present invention showing both their upper (top) and lower (bottom) coverplates. The traditional cavity/hole number labeling has not been omitted in the present invention. They are now more clearly marked than ever before so as not to be confused with the scale degrees' numbers by circling them (①), now representing them truly as a "hole"/cavity, and are placed above their associated blow oriented notes and cavities (holes) within, typically, the upper (top) coverplate though they could also be put on the lower (bottom) coverplate if so desired.

Figure 4:
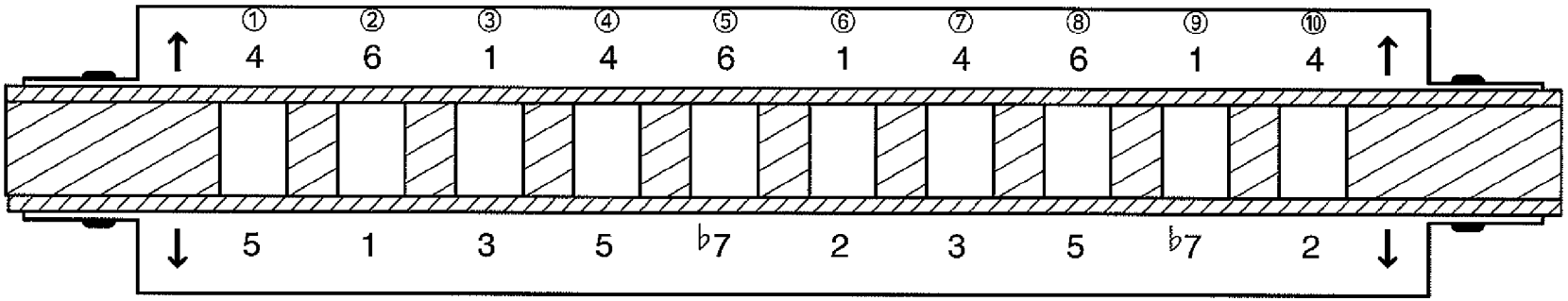
FIG. 4 illustrates the front view of a conventional harmonica's upper and lower (top and bottom) coverplates constructed in accord with a preferred embodiment of the present invention. It shows, in standard Richter tuning, "cross-harp's" primary blow and draw scale notes in scale degree numbers on the upper (top) and lower (bottom) coverplates respectively with related wind direction arrows on the sides. Circled cavity (hole) numbers are located on the upper (top) coverplate above the scale degrees over their respective cavities (holes). This simple embodiment is meant for beginning harmonica players.

Reference is now made to FIG. 4 of the front view of a diatonic harmonica's upper (top) and lower (bottom) coverplates constructed in accord with the present invention. Its tuning layout is the Richter tuning of a conventional diatonic harmonica and presents the primary scale of its "cross-harp" key. In FIG. 4's diagram, by way of example, the observer now sees the number "4" directly above the first cavity (hole) on the harmonica's upper (top) coverplate. This is communicating to the student that the fourth degree of the primary scale of this particular tuning scheme is located in this particular cavity (hole) and that it is a blow oriented note because it is displayed on the upper (top) coverplate and reinforced by the blow wind direction arrows (↑) found on the far sides of the same coverplate. Below the same said cavity (hole) on the bottom (lower) coverplate is displayed the number "5". This is communicating to the student that the fifth degree of the primary scale is located in this same cavity (hole) and that it is a draw oriented note because it is located on the lower (bottom) coverplate and reinforced by the draw wind direction arrows (↓) found on the far sides of this coverplate. The same process has been applied to the other cavities (holes) of the instrument, thus now showing the complete layout of the harmonica's full primary scale associated with their respective cavities (holes) that they are located in, all defined in musical scale degree numbers. To complete the picture, the conventional cavity (hole) numbers (now circled) are placed above their associated blow oriented notes and cavities (holes) on the upper (top) coverplate. In this way not only does the student see where all of the harmonica's primary pitches are located and their specific wind direction that they are acquired with, but at the same time, with the same symbol, what specific note of the scale they are. This embodiment of FIG. 4 is meant for the beginning harmonica student so only the primary scale is presented though the additional related modal scales could well be presented in one of the said coverplates as they are in FIG. 7 or 11 if so desired.

On a simple diatonic harmonica, many other additional associated notes not in the harmonica's fixed pitch scale are available to the player through the employment of the advanced harmonica techniques of "overblowing", "overdrawing" and the most common & expressive one, that of "bending". Each different tuning comes with its own inherent way of how these techniques can be applied and the limits of what each can produce. In the case of the more complex slide chromatic harmonica (not shown in the FIGURES), its additional associated notes are achieved by activating its slide/button mechanism. The present invention is the first time any of these notes have been identified and located on the harmonica itself.

Overblowing and overdrawing to add notes on the diatonic harmonica were discovered in the 1940s and have become more popular in recent years though more difficult to do. They only work on the lowest pitched reed in the cavity (hole) irrespective of whether it is a blow note (overblowing) or draw note (overdrawing) and always produce a note that is ½ step up in pitch from the higher pitched reed of the opposite wind direction in the cavity (hole). Wherever the inventor's use of superscripting numbers is displayed in the FIGURES, it presents these additional notes made available by "overblowing" or "overdrawing". Similar kinds of graphics could be used to indicate the slide chromatic's slide-activated additional associated notes which typically go up in pitch due to its particular tuning layout and slide construction.

Figure 5:
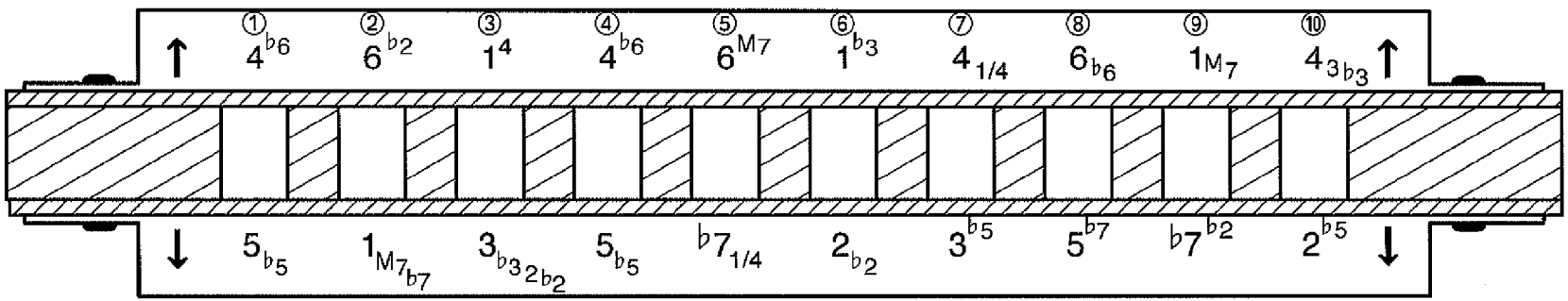
FIG. 5 illustrates the front view of a conventional harmonica's upper and lower (top and bottom) coverplates constructed in accord with the present invention showing FIG. 4's tuning scheme and layout with its additional associated overblow and overdraw (superscripted) notes, and bend (subscripted) notes also displayed. Related wind direction arrows on the sides of both coverplates and circled cavity (hole) numbers on the upper (top) one are also shown.
Figure 8:
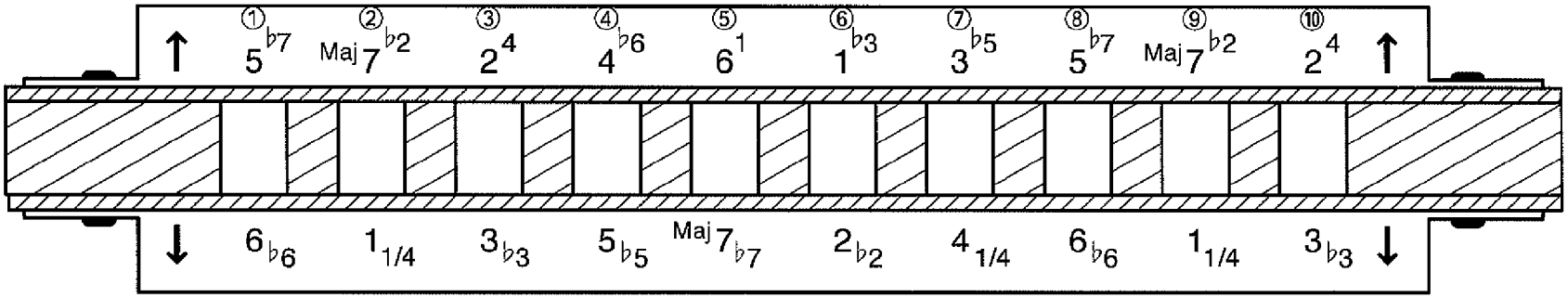
FIG. 8 illustrates the front view of a harmonica's upper (top) and lower (bottom) coverplates constructed in accord with another preferred embodiment of the present invention. They show in scale degree numbers FIG. 6's primary scale with the inclusion of its additional associated overblow (superscripted) and bend (subscripted) notes on the upper and lower coverplates respectively, displayed with their associated primary notes and cavities (holes). Related wind direction arrows are on the sides of both coverplates and circled cavity (hole) numbers are located above the blow notes and their respective cavities (holes) on the upper (top) coverplate.
Figure 9:
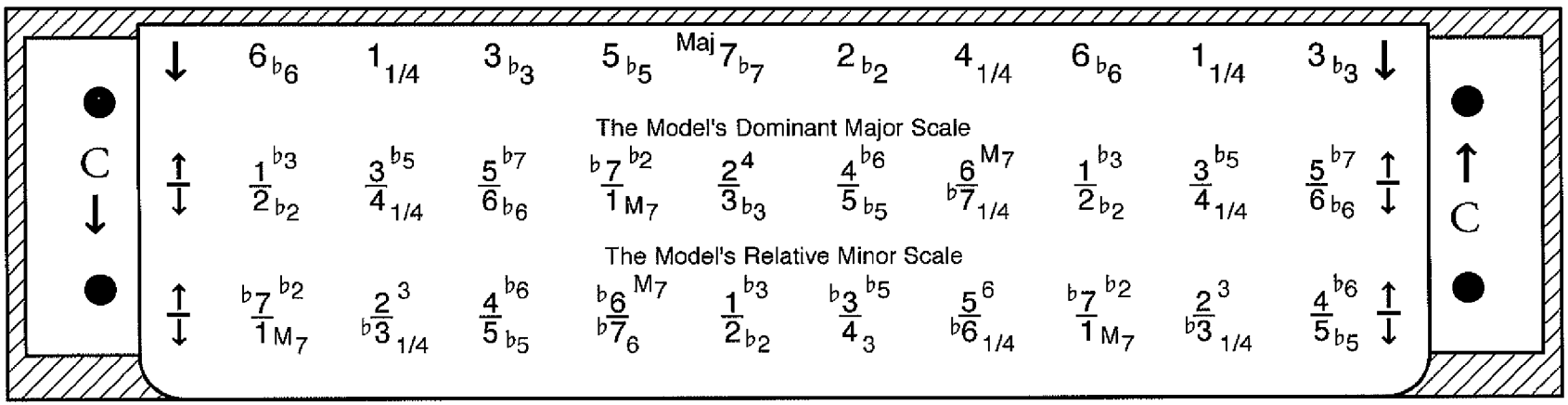
FIG. 9 illustrates a bottom view of the embodiment of FIG. 8's lower (bottom) coverplate constructed in accord with the present invention showing its draw-oriented primary scale notes with their additional bend notes (subscripted) and related wind direction arrows. Below that are other related modal scales in scale degree numbers and their wind direction arrows (both in the vertical fraction form of FIG. 7) accompanied with their additional overblow (superscripted) notes and bend (subscripted) notes.

The other and most common way of adding additional notes to the player's pallet is accomplished through the easier and more expressive harmonica technique that's commonly referred to as "bending". Bending also allows the pitch to "slide" from note to note (a glissando-like effect) and gives a vocal-like quality to the sound that has become very popular in modern harmonica playing. Not necessarily intended by the original inventor (like the other two techniques), it wasn't fully discovered and appreciated until harmonica started to be played in "cross harp" by the Blues players of the late 1800s. To their surprise, draw note bending also allowed the players to add in some of very important missing notes in the bottom of the primary scale as shown in FIG. 5. It is essentially the opposite of overblowing in the sense that it can only be applied to the higher fixed pitched reed in a particular cavity (hole) of a simple diatonic harmonica. The bending process provides all the half step chromatic notes and/or quarter tones that are between the highest fixed pitched note in the cavity (hole) and the lowest fixed pitched note in the same said cavity (hole). Wherever the inventor's use of subscripting numbers is displayed it presents these additional notes made available by "bending". When a half step of the chromatic scale can't be obtained from bending because of the closeness of pitch between the two reeds of a cavity (hole), a quarter tone (the distance between two sequential half step notes of the chromatic scale) results and is represented in FIGS. 5, 8 and 9 by the subscripted horizontal fraction of ¼. With the present invention, this is the first time that these additional associated notes (i.e.—bends, overblows, overdraws or slide-activated notes) have been located within the structure of a harmonica's integral coverplates, thereby giving the student more information and educational utility than ever before about their cavity (hole) locations and their scalar identification and done simultaneously with the same symbols—music numbers that are universally known.

Reference is now made to FIG. 5 of the front view of a diatonic harmonica's upper (top) and lower (bottom) coverplates constructed in accord with the present invention. Its tuning layout is the same Richter scheme as in FIG. 4 with the inclusion of the primary scale's additional associated notes playable in this design by overblowing, overdrawing and bending. In FIG. 5's diagram, by way of example, the observer now sees the number "4" directly above the first cavity (hole) on the harmonica's upper (top) coverplate and a superscripted number "$^{b}6$" next to it. This is communicating to the student that the fourth degree of the primary scale of the particular tuning scheme of the harmonica is located in this particular cavity (hole) and that it's a blow-oriented note because of being displayed on the upper (top) coverplate and reinforced by the blow wind direction arrows (↑) found on the far sides of the face of the said coverplate. The superscripted musical number "$^{b}6$" next to it represents the overblow note acquired in the same said cavity (hole) from overblowing. Below the same said cavity (hole) on the bottom (lower) coverplate is the number "5". This is communicating to the player that the fifth degree of the primary scale is located in this same cavity (hole) and that it is a draw oriented note because it is displayed within the lower (bottom) coverplate and reinforced by the draw wind direction arrows (↓) found on the far sides of this coverplate. Next to the primary draw note (the "5") is the subscripted musical number "$^{b}5$" which indicates the scale degree of the "bend note" obtained from draw-bending in this particular cavity (hole). The same process has been applied to the other cavities (holes) of the instrument, thus now showing the complete layout of the harmonica's full primary scale and its additional associated overblows, overdraws and bend notes displayed overtop or underneath their respective cavities (holes) that they are located in, all defined in musical scale degree numbers. The blow-oriented primary scale notes with their additional associated overblow notes (superscripted), located in cavities/holes ① thru ⑥, and their additional associated upper cavity (hole) blow bends (subscripted) found in cavities/holes ⑦ thru ⑩ are all situated on the upper (top) coverplate directly above their respective cavities (holes). The draw-oriented primary scale notes and their additional associated draw bends (subscripted) located in cavities/holes ① thru ⑥, and their additional associated overdraw notes (superscripted) that are located in cavities/holes ⑦ thru ⑩ are all now found on the lower (bottom) coverplate situated directly under the cavity (hole) they are located in. Where no full blow bends exist (cavity/hole ⑦) and where no full draw bends exist (cavity/hole ⑤), the subscripted horizontal fraction of ¼ is found representing the "quarter tone note" obtained when the bending process is applied to that particular note. To complete the picture, the conventional cavity (hole) numbers (now circled) are placed above their associated blow oriented notes and cavities (holes) on the upper (top) coverplate. In this way not only does the student see where all of the harmonica's pitches are located and their specific wind direction and harmonica technique that they are acquired with, but at the same time with the same symbol, what specific note of the primary scale they are. This is now the first time that all of this musical scale information has ever been presented within the structure of a harmonica, thus transforming it from a performance instrument into a music learning and self-teaching device.

Reference is now made towards FIG. 6, constructed in accord with the present invention showing the front view of a diatonic harmonica's upper (top) and lower (bottom) coverplates that are displayed with another particular "tuning scheme" which has a fuller and more complete draw oriented primary scale. It is the same tuning scheme used for the rest of the FIGURES of the present invention (FIGS. 6 thru 11) and has an inherent logic and harmonic sense to it that shows the present invention's concepts very clearly. Its tuning scheme has a much clearer approach towards teaching music harmony than Richter's tuning because of having all of its seven note primary scale in total harmony throughout the whole range of the instrument. The particular tuning scheme though is not the main focus here as any scale could have its tuning layout stated in such musical number terms. In FIG. 6's diagram, by way of example, the observer now sees the number "5" above the first cavity (hole) on the harmonica's upper (top) coverplate. This is communicating to the student that the fifth degree of the primary scale of the particular tuning scheme of the harmonica is located in this particular cavity (hole) and that it's a blow oriented note because of being displayed on the upper (top) coverplate and reinforced by the blow wind direction arrows (↑) found on the far sides of the face of the said coverplate. Below the same said cavity (hole) on the bottom (lower) coverplate is the number "6". This is communicating to the student that the sixth degree of the primary scale is located in this same cavity (hole) and that it is a draw oriented note because it is displayed on the lower (bottom) coverplate and reinforced by the draw wind direction arrows (↓) found on the far sides of the face of this coverplate. The same process has been applied to the other cavities (holes) of the instrument, thus now showing the complete layout of the harmonica's full primary scale associated with their respective cavities (holes) that they are located in, all defined in musical scale degree numbers. The conventional cavity (hole) numbers (now circled) are placed above their associated blow oriented notes and cavities (holes) on the upper (top) coverplate. This embodiment is meant for the beginning harmonica student so only the primary scale is presented.

Reference is now made towards FIG. 7, constructed in accord with the present invention showing the "bottom view" of the entire lower (bottom) coverplate of FIG. 6. The primary scale's draw-oriented scale notes are displayed underneath their associated cavities (holes) that their pitches are located in. Draw wind direction arrows are situated on the far sides of the face of the said coverplate in line with the draw scale's primary notes presenting the particular wind direction employed to obtain these said notes. Below those listings, are displayed vertical fractions running consecutively from left to right with their listings lined up directly under their associated cavities (holes) where their individual notes are located.

They present the location of both the related scale's blow notes in the numerator's place and the draw notes in the denominator's place. These vertical fractions present and make available for the student, for the first time, a harmonica's other important related modal scales. They represent, in musical numbers, the notes of each selected scale as they progress upward (from left to right) in pitch. These additional scales represent other important scales that can be made from the primary scale when it is played starting from a different note other than the primary scale's tonic note (its first degree—the "1") and are commonly known as a harmonica's other "positions". They produce other related minor and/or major scales depending on what kind of scale is selected as "the primary scale". Starting from any and every note of the primary scale, a new scale is generated. In this FIGURE's case (similar to FIGS. 9 and 11), the inventor has chosen to display two of the most important ones, the primary scale's "dominant major scale" and its "relative minor scale". Each of the important related scales/modes chosen to be displayed are presented above each scale/mode with their appropriate musical word term descriptions for the sake of easy identification as to what scale/mode is being shown. (Note: Here is the case where, in the present invention, word phrases must be used in the drawings to identify the information shown—there is no other clear way to convey this important information.) On each of the far sides of these lines of vertical fractions of numbers are other vertical fractions made with arrows pointing up and down. These represent the wind directions to be employed to play the harmonica's other related modal scales referred to above. These fractions are designed with the same logic—the arrow pointing up in the numerator's place represents the blow wind direction and the arrow pointing down represents the draw wind direction to produce the said notes of the other related modal scales. These function, as the other wind direction arrows of the present invention's different embodiments do, as "map keys", so to speak.

Reference is now made to FIG. 8 of the front view of a diatonic harmonica's upper (top) and lower (bottom) coverplates constructed in accord with the present invention. FIG. 8 contains the same "harmony tuning scheme" as found in FIGS. 6, 7 and FIGS. 9-11. On the upper (top) coverplate are presented, above the cavities (holes) they are associated with, the blow-oriented primary scale notes along with their additional associated overblows (superscripted) in ordinal musical scale numbers. Blow wind direction arrows are found on the far sides of the face of the said coverplate and circled cavity (hole) numbers are displayed above the primary scale's notes and cavities (holes) that they are specifically located in. On the lower (bottom) coverplate are presented, below their associated cavities (holes), the primary scale's draw-oriented notes and their additional associated bends notes (subscripted) in the aforementioned ordinal musical scale numbers. Draw wind direction arrows are also found on the far sides of the face of the said coverplate to let the player know that here is where the draw notes are located. Once again, where a full half-step bend note can't physically be obtained by bending (draw cavities/holes ②, ⑦, and ⑨), the resulting "quarter tone note" (that can be obtained) is represented by the subscripted horizontal fraction of ¼.

Reference is now made towards FIG. 9, constructed in accord with the present invention showing the "bottom view" of the entire lower (bottom) coverplate of FIG. 8. The primary scale's draw-oriented scale notes are presented underneath their associated cavities (holes) that their pitches are located in, accompanied by their additional associated bend notes (subscripted) produced by each particular draw reed. Draw wind direction arrows are situated on the far sides of the face of the said coverplate in line with the draw scale's primary notes and associated bend notes reinforcing the particular wind direction employed to obtain these said notes. Below those listings (similar to FIGS. 7 and 11) are displayed the aforementioned vertical fractions running consecutively from left to right with their listings lined up directly under their associated cavities (holes) where their individual notes are located. They represent, in musical numbers, the notes of each selected scale as they progress upward (from left to right) in pitch with the numerator representing the blow note of the selected scale and the denominator representing the draw note of the scale. Above each scale is presented a necessary word description of that scale, similarly described in FIG. 7 as well as the wind direction arrows in the same vertical fraction form found on the ends of the face of the said coverplate. The addition here (that is not similar to FIGS. 7 and 11) is the inclusion of the related scales' other additional associated notes created by overblowing (superscripted) and bending (subscripted). With this FIGURE taken in conjunction with the top coverplate of FIG. 8, we now obtain a full picture. Now all of the playable notes of all of the indicated scales are shown to the student in music numbers.

Figure 10:
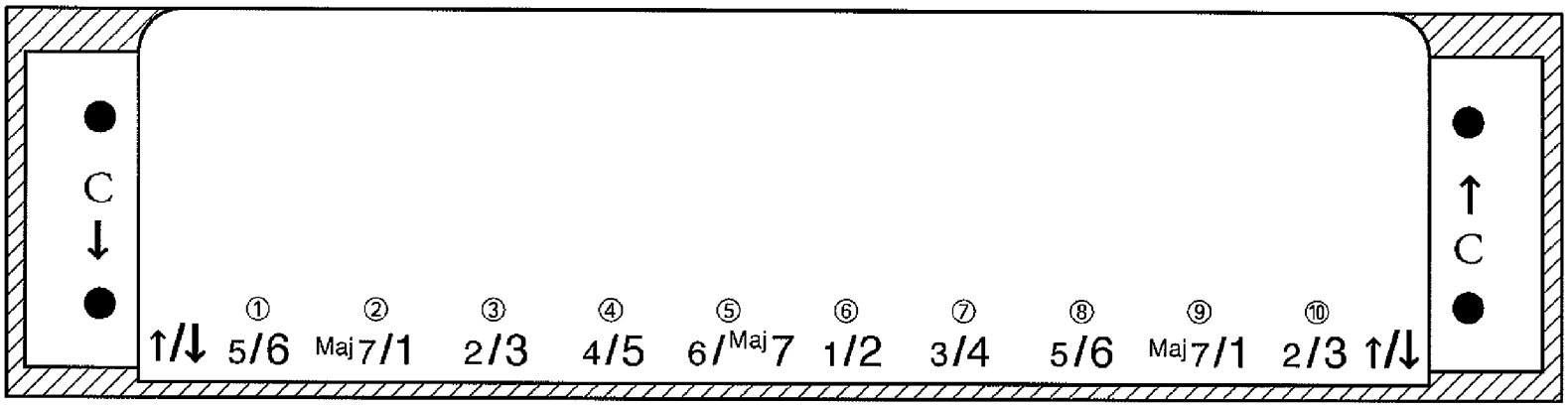
FIG. 10 illustrates the top view of a harmonica's upper (top) coverplate constructed in accord with another preferred embodiment of the present invention with FIG. 6's complete primary scale information with wind direction arrows and associated cavity (hole) numbers all on one of the said coverplates. The wind direction of each note is determined by different font sizings (smaller—blow notes/larger—raw notes) and are separated by a "slash" mark. The wind direction arrows are displayed on the sides in a likewise fashion. With only the primary scale displayed, this embodiment is meant for the beginner harmonica player. Typically, as shown in this FIGURE, all of this would be located on the upper (top) coverplate with the other coverplate blank but this too can be varied as in FIG. 11.

Reference is now made to FIG. 10, showing the top view of a diatonic harmonica's upper (top) coverplate constructed in accord with the present invention. It shows a variation of the present invention's system that locates the harmonica's primary scale information (in this case, of FIG. 6's primary scalar information) onto one of its said integral coverplates for the beginner harmonica student. Typically, in most cases, this would be presented on the upper (top) coverplate because it's typically the coverplate that's looked at first (the cultural convention is to read from left to right and top to bottom), though it could be located on the lower (bottom) coverplate as it is in FIG. 11. The graphics for this arrangement are done through the font sizing of the different scale notes and their wind directions with the addition of the graphic symbol of "the slash mark" (or other such graphic means—i.e. a hyphen, dash, star, etc.) separating the different wind directions of the two said notes of a specific cavity (hole). Here is an example of what the inventor means by employing this kind of system in these FIGURES: 5/6, with the smaller 5 indicating that the fifth degree of the harmonica's scale is located by blowing in this particular cavity (hole) and the sixth degree of the scale represented by the larger 6 which would be indicating that it is a draw oriented note found in this particular cavity (hole). This information is situated directly above (or below) the particular cavity (hole) where the said notes of the primary scale are located with circled cavity (hole) numbers right above them. A similar kind of graphic means is employed to represent both wind direction arrows set on the far sides of the face of the coverplate done as such: ↑/↓ with them serving as a "map key" or legend for the scale notes and their wind directions mentioned above. By the use of the smaller font, the small arrow pointing up is indicating the blow wind direction of primary scale's blow notes, and in the larger font, the larger arrow pointing downwards is indicating the draw wind direction of the primary scale's draw notes. Variations of this kind of system such as reversing the font sizes are understood to be obvious to those "skilled in the art".

Figure 11:
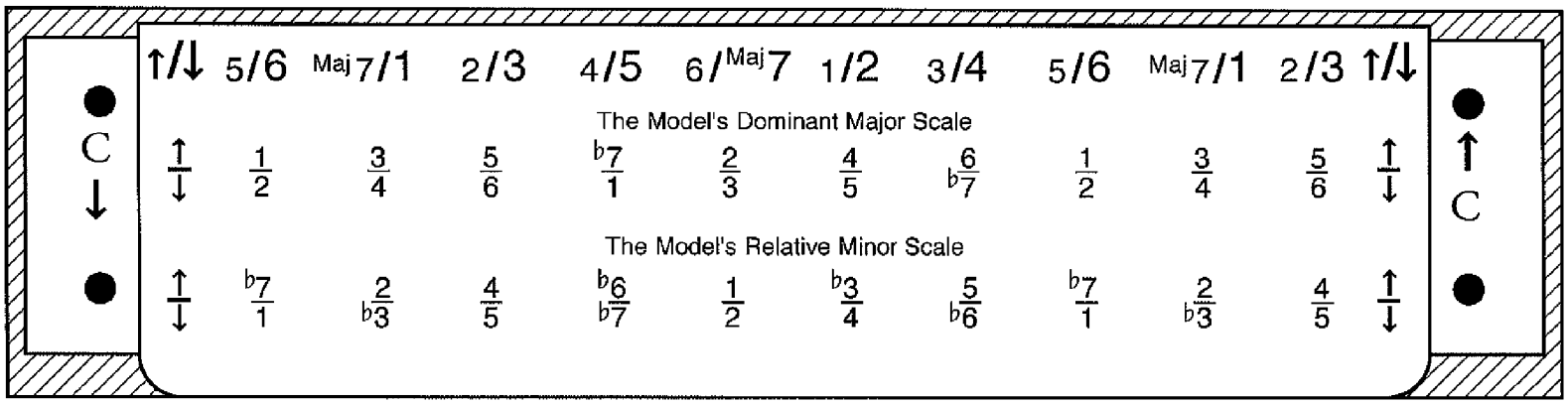
FIG. 11 illustrates the bottom view of a harmonica's lower (bottom) coverplate constructed in accord with another preferred embodiment of the present invention showing FIG. 10's complete primary scale relocated to the lower coverplate with the inclusion below that of (in the same way as in FIG. 7) its other related modal scales with their wind direction arrows by their sides in their vertical fraction form, all on one of the said coverplates. This leaves the upper (top) coverplate open for the model's artwork or the top coverplate from FIG. 2 (of Prior Art) with only its cavity (hole) numbers would be used.

Reference is now made to FIG. 11 showing the "bottom view" of the entire lower (bottom) coverplate of a diatonic harmonica constructed in accord with the present invention. Similar to FIG. 10, it has all of its primary scale information on one of the said coverplates while also displaying some of the additional related scales. It is another embodiment meant for the beginner harmonica student. It shows the primary scale information by the same graphic means of FIG. 10 incl.

the wind direction arrows only now presented at the top of the bottom coverplate which situates the scale information now directly below their associated cavities (holes). Below those listings are presented in the same way as described in FIG. 7 the other related scales in their typical vertical fraction form along with their wind direction vertical fractions on the sides. In this way, the top coverplate could then be done just like FIG. 2 (of Prior Art) and just have cavity (hole) numbers.

In summation, this is the first time that all of this musical information has ever been incorporated into the structure of a harmonica. The aspect of the present invention found within a harmonica's integral coverplates (stamped or otherwise) provides to the student comprehensive educational information about a harmonica's tuning layout and note location—and it is all taken in with one quick glance. This easily-accessed information reinforces the learning of music theory every time it is used. The present invention elevates the BLOW and DRAW harmonica to become a stand alone teaching tool for identifying and learning musical structures and note locations—in musical numbers, the true language of music, essentially transforming the harmonica from a performance tool into a unique and superior self-teaching apparatus.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents. What is claimed is:

APPENDIX C

APPENDIX C

The Magic Key Of Learning
Cross-Reference Chart of FIGURES &
their corresponding Claim Numbers Prior Art FIG. #s
FIGS. 1-3
The Present Invention
FIGS. 4 & 5 - Richter Tuning FIGS. 6-11 Harmony Tuning

| FIGURE #<br>T = top coverplate<br>B = bottom coverplate | corresponds to | Claim #s<br>(Independent Claims - #s 1, 3, 5, 7, 9 and 11) |
|---|---|---|
| FIG. 4 (front view of T & B)<br>Primary scale only | | #1 & #7 |
| FIG. 5 (front view of T & B)<br>Primary scale<br>w/overblows/overdraws & bends | | #3 & #9 |
| FIG. 6 (front view of T & B)<br>Primary scale only | | #1 & #7 |
| FIG. 7 (bottom view of FIG. 6's B)<br>Draw notes of primary scale<br>w/other related scales | | #2 of #1<br>and<br>#8 of #7 |
| FIG. 8 (front view of T & B)<br>Primary scale<br>w/overblows & bends | | #3 & #9 |
| FIG. 9 (bottom view of FIG. 8's B)<br>Draw notes of primary scale<br>w/other related scales<br>& their overblows & bends | | #4 of #3<br>and<br>#10 of #9 |
| FIG. 10 (top view of T)<br>All on one coverplate -<br>Primary scale only | | #5 & #11 |
| FIG. 11 (bottom view of B)<br>All on one coverplate -<br>Primary & other related scales only | | #6 of #5<br>and<br>#12 of #11 |

What is claimed is:

1. A self-contained, harmonica-playing, music education device that displays for a student-user immediately upon viewing said device, the location and music symbols for all of the predetermined fixed music pitches which can be produced on the device, said predetermined fixed music pitches constituting the device's primary music scale, said device comprising:

(a.) a harmonica including a body and divider structure with a set of top and bottom reed plates, therebetween providing a series of adjacent parallel cavities between the said reed plates and, mounted on said reed plates are a plurality of reeds, each of which is responsive to the passage of air normally to produce an audible musical note of a certain predetermined pitch, a pair of said reeds being in each of said cavities such that one of each cavity placed reeds is a Blow reed responsive to blowing air through said cavity to produce a Blow note and the other of the pair of associated reeds is a Draw reed responsive to drawing air through said cavity to produce a Draw note, and, (b.) a set of harmonica coverplates with top and bottom outer faces; one upper (top) coverplate covering the said harmonica's upper reed plate and the other lower (bottom) coverplate covering the harmonicas lower reed plate, and, (c.) a first set of numeric music and air direction indicia with:

(i.) the portion of said set of indicia corresponding to the pitches of the Blow reeds, displayed on one of said cover plates, directly overtop or underneath their corresponding note cavities, and, (ii.) the other portion of said set of indicia corresponding to the pitches of the Draw reeds, displayed on the other one of said cover plates, directly overtop or underneath their corresponding note cavities.

2. The device of claim 1 with the said indicia constructed and arranged in relation to the pitches of notes and cavity and reed structures to facilitate, for a student-user of the device, a comprehension of the mathematical relational structures of said device's predetermined fixed musical pitches constituting said device's primary music scale, such construction and arrangement comprising a second set of numeric music and air direction indicia, designating one or more modes or positions of said device's primary scale, displayed on either or both of said cover plates, directly overtop or underneath their corresponding note cavities.

3. The device of claim 2 with the said indicia constructed and arranged in relation to the pitches of notes and cavity and reed structures to facilitate, for a student-user of the device, a comprehension of the mathematical relational structures of all of said device's additional non-fixed pitches which can be produced on the device by the student-user through the playing techniques of bending and overblowing/overdrawing, such construction and arrangement comprising a third set of numeric music and air direction indicia, designating said additional non-fixed pitches, displayed with their corresponding said second set of indicia on the said cover plates of the second set, directly overtop or underneath their corresponding note cavities.

4. The device of claim 1 with the said indicia constructed and arranged in relation to the pitches of notes and cavity and reed structures to facilitate, for a student-user of the device, a comprehension of the mathematical relational structures of all of said device's additional non-fixed pitches which can be produced on the device by the student-user through the playing techniques of bending and overblowing/overdrawing, such construction and arrangement comprising a third set of numeric music and air direction indicia, designating said additional non-fixed pitches, displayed with their corresponding said first set of indicia on the said cover plates of the first set, directly overtop or underneath their corresponding note cavities.

5. A self-contained, harmonica-playing, music education device that displays for the student-user immediately upon viewing said device, the location and music symbols for all of the predetermined fixed music pitches which can be produced on the device, said predetermined fixed music pitches constituting the device's primary music scale, with said device comprising:

(a.) a harmonica including a body and divider structure with a set of top and bottom reed plates, therebetween providing a series of adjacent parallel cavities between the said reed plates and, mounted on said reed plates are a plurality of reeds, each of which is responsive to the passage of air normally to produce an audible musical note of a certain predetermined pitch, a pair of said reeds being in each of said cavities such that one of each cavity placed reeds is a Blow reed responsive to blowing air through said cavity to produce a Blow note and the other of the pair of associated reeds is a Draw reed responsive to drawing air through said cavity to produce a Draw note, and, (b.) a set of harmonica coverplates with top and bottom outer faces; one upper (top) coverplate covering the said harmonica's upper reed board and the other lower (bottom) coverplate covering the harmonica's lower reed board, and, (c.) a first set of numeric music and air direction indicia with:

(i.) the portion of said set of indicia corresponding to the pitches of the Blow reeds, displayed on only one of said cover plates, directly overtop or underneath their corresponding note cavities, and, (ii.) the other portion of said set of indicia corresponding to the pitches of the Draw reeds, displayed on the same one of said cover plates, directly overtop or underneath their corresponding note cavities.

6. The device of claim 5 with the said indicia constructed and arranged in relation to the pitches of notes and cavity and reed structures to facilitate, for a student-user of the device, a comprehension of the mathematical relational structures of said device's predetermined fixed musical pitches constituting said device's primary music scale, such construction and arrangement comprising a second set of numeric music and air direction indicia, designating one or more modes or positions of said device's primary scale, displayed on either or both of said cover plates, directly overtop or underneath their corresponding note cavities.

* * * * *

UNITED STATES PATENT AND TRADEMARK OFFICE

CERTIFICATE OF CORRECTION

PATENT NO. : 8,431,807 B1
APPLICATION NO. : 12/899000
DATED : April 30, 2013
INVENTOR(S) : Beauregard, IV It is certified that error appears in the above-identified patent and that said Letters Patent is hereby corrected as shown below:

On the Title Page

Title page, illustrative figs. 4 and 6 should be deleted and substitute therefor the attached title page consisting of figs. 6 and 7.

Signed and Sealed this
Twenty-fifth Day of February, 2014

Michelle K. Lee

Michelle K. Lee
*Deputy Director of the United States Patent and Trademark Office*

(12) United States Patent
Beauregard, IV

(10) Patent No.: US 8,431,807 B1
(45) Date of Patent: Apr. 30, 2013

(54) MAGIC KEY OF LEARNING

(76) Inventor: Pierre G. T. Beauregard, IV, North Truro, MA (US)

( * ) Notice: Subject to any disclaimer, the term of this patent is extended or adjusted under 35 U.S.C. 154(b) by 97 days.

(21) Appl. No.: 12/899,000

(22) Filed: Oct. 6, 2010

Related U.S. Application Data

(60) Provisional application No. 61/253,240, filed on Oct. 20, 2009.

(51) Int. Cl.
*G10D 7/12* (2006.01)

(52) U.S. Cl.
USPC ..... 84/377

(58) Field of Classification Search ..... 84/377–379, 84/470 R, 483, 483.2, 484, 471 R1
See application file for complete search history.

(56) References Cited

U.S. PATENT DOCUMENTS

| | | | | |
|---|---|---|---|---|
| 2,263,052 | A | 11/1941 | Ross | |
| 2,925,273 | A | 2/1958 | Pratt | |
| 3,110,494 | A | 11/1963 | Morgan | |
| 4,286,783 | A | 9/1981 | Newcomb et al. | |
| 4,846,471 | A | 7/1989 | Haysom | |
| 5,309,812 | A * | 5/1994 | Shelton | 84/471 R |
| 5,407,193 | A | 4/1995 | McGinley | |

* cited by examiner

*Primary Examiner* — Kimberly Lockett
(74) *Attorney, Agent, or Firm* — Burns & Levinson LLP; Jerry Cohen

(57) ABSTRACT

This invention is a self-contained, Blow and Draw harmonica-playing, music education device that displays for the student-user —immediately upon viewing the device's coverplates—the location and music symbols for 1./ all of the predetermined fixed music pitches which can be produced on the device (its primary scale—presenting the 1st level of instruction), 2./ one or more of the primary scale's related modal scales (its positions—the 2nd level of instruction) and, 3./ all of the additional non-fixed notes produced by the student-user through the playing techniques of bending & overblowing/overdrawing (the 3rd level of instruction)—with all three levels displayed by three separate sets of numeric music and air direction indicia located on the harmonica device's coverplates directly underneath or overtop their corresponding harmonica reed cavities. The totality of this invention is a harmonica device that is a self-contained, self-teaching educational tool—teaching musical structures & theory, the instrument's particular inner harmony structure, its modal relationships, and, displaying all of the notes playable on the instrument with their exact locations for the very first time.

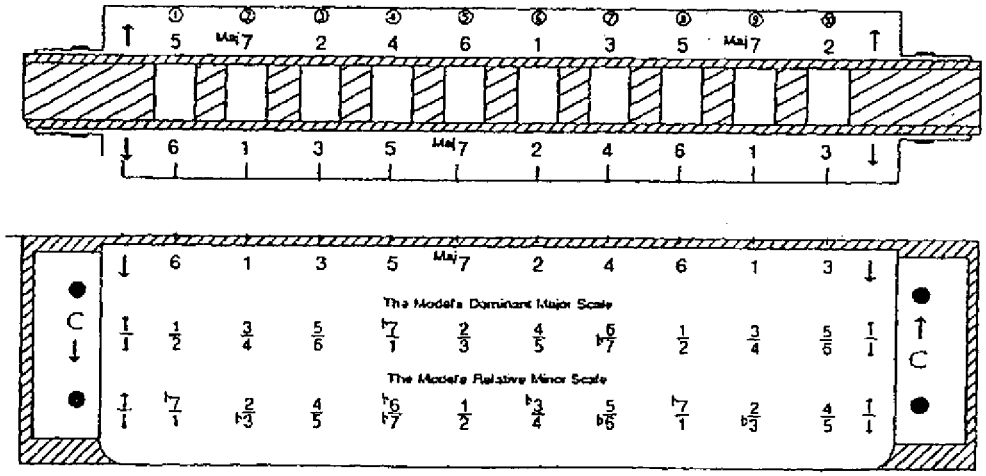

6 Claims, 7 Drawing Sheets